US006055008A

United States Patent [19]

Bliss

[11] Patent Number: 6,055,008

[45] Date of Patent: Apr. 25, 2000

[54] ELECTROSTATIC PRINTER HAVING TWO-DIMENSIONAL HUMIDITY COMPENSATION

[75] Inventor: Arthur E. Bliss, Sunnyvale, Calif.

[73] Assignee: Phoenix Precision Graphics, Inc., Sunnyvale, Calif.

[21] Appl. No.: 08/895,153

[22] Filed: Jul. 16, 1997

[51] Int. Cl.[7] ..... B41J 2/385

[52] U.S. Cl. ..... 347/133; 347/116; 347/144; 399/44

[58] Field of Search ..... 347/116, 152, 347/900, 115, 144, 133; 399/28, 44; 400/582

[56] References Cited

U.S. PATENT DOCUMENTS

| | | | |
|---|---|---|---|
| 4,772,901 | 9/1988 | Boyer et al. | 347/126 |
| 4,949,104 | 8/1990 | Negoro et al. | 347/139 |
| 5,266,976 | 11/1993 | Ohigashi et al. | 347/116 |
| 5,552,862 | 9/1996 | Masuda et al. | 347/152 |

*Primary Examiner*—N. Le
*Assistant Examiner*—Hai C. Pham
*Attorney, Agent, or Firm*—Thomas Schneck

[57] ABSTRACT

A printer employing a scanning electrostatic print head includes a sensor to determine dimensional variations in a printable dielectric material, such as paper, on which a latent electrostatic image is disposed. A charge deposition delay circuit is in electrical communication with the scanning print head which allows properly positioning the electrostatic image on the dielectric material to compensate for the dimensional variations.

17 Claims, 7 Drawing Sheets

ELECTROSTATIC PRINTER HAVING TWO-DIMENSIONAL HUMIDITY COMPENSATION

TECHNICAL FIELD

The present invention pertains to the field of electrostatic printing. Specifically, the present invention pertains to an electrostatic printer with compensation for humidity variations.

BACKGROUND ART

Electrostatic printers and copiers commonly use an electrostatic writing head to form a latent image of electrical charges onto recording media having a dielectric and conductive layer, commonly referred to as a paper web. The paper web carrying the latent image is then directed to a liquid toning applicator which deposits oppositely charged toner particles onto the paper web, thereby developing the latent image.

An important consideration in controlling image quality is positioning of the charge deposited on the paper web. This is necessary considering that multiple colors are applied to a given area of the paper-web by successive applications of a latent image and toner particles. Wide-format electrostatic printers use a full-width print head to deposit a latent charge on dielectric media. To obtain high resolution printing, e.g., 400 dpi, a large number of electrodes must be employed so that the print head is coextensive with the width of the paper web. For example, a 36 inch wide print head would require 14,400 electrodes. A drawback with the full width print head is that its width is fixed. This may prove problematic in areas that have varying humidity, because the dimensions of the paper web change proportionally to the level of humidity present.

One manner in which to overcome the drawback with full width print heads is to operate the electrostatic printer in a humidity controlled environment. Alternatively, the paper web may be placed in an existing environment for a time sufficient to allow the paper web to stabilize. In this fashion, no further dimensional changes in the paper web would occur due to environmental humidity. Both of these approaches increase the cost to produce electrostatic prints.

Many prior art devices have been employed to compensate for dimensional changes in a substrate due to variances in ambient humidity. U.S. Pat. No. 4,949,104 to Negoro et al. discloses a justification system for a printer employing a continuous recording form. The justification system includes, inter alia, a timing pulse signal generating system which creates timing pulses in synchronism with traveling sprocket holes formed into the continuous recording form. The timing pulses signal the commencing of the printing on each printing segment, as well as the termination of the advancement of the continuous recording form. This system allows positional placement of the continuous form along a direction parallel to the direction of the form's travel so that printing may be accurately placed thereon.

U.S. Pat. No. 4,772,901 to Boyer et al. discloses an electrostatic printer employing dehumidified air. The printer includes, inter alia, an ion modulated electrostatic print head for forming latent electrostatic images, a dielectric imaging member comprising a layer of dielectric material, means for developing the latent electrostatic images on the dielectric imaging member, means for supplying unheated dehumidified air having a relative humidity of less than about 20% and directing the same onto the dielectric imaging member.

A problem encountered with the aforementioned inventions is that neither electrostatic print apparatus allows compensation for dimensional changes in the widthwise direction of the dielectric material. What is needed is a scanning electrostatic printer that compensates for dimensional variations in the dielectric material by allowing spatial adjustments in the placement, thereon, of an electrostatic image along two dimensions.

SUMMARY OF THE INVENTION

An electrostatic printer of the type having a print head and a supply of printable dielectric material, such as paper, features a measuring device to measure the dimensional changes of the printable dielectric material due to changes in humidity of an ambient atmosphere or other environment. Fiber materials, such as paper, are particularly vulnerable to dimensional variations with changes in ambient moisture. A feedback system adjusts the position of the electrostatic image in response to the measured dimensional changes.

The electrostatic printer of the present invention includes a paper supply roller and take-up roller to accurately position the printable dielectric material, such as a paper web, adjacent to the electrodes of an electrostatic print head, which is located between the rollers. The electrodes are typically a plurality of wires. The print head moves across the width of paper web to dispose thereon a plurality of charge areas corresponding to a strip of a latent electrostatic image. Control circuitry synchronizes the movement of both the print head and the web to create a plurality of abutting strips of charge areas, producing a complete latent image. A toner applicator is positioned adjacent to the print head to dispose ionized toner particles which adhere to the charge areas, thereby producing a visible image.

In one embodiment, the measuring device includes a humidity sensor to detect a relative humidity of the ambient atmosphere, producing information corresponding thereto, a processor and a memory, in electronic communication with the logic unit. The processor is coupled to receive the information and determine, from the data, the dimensional variations. The memory stores data concerning a change in dimensions of the printable dielectric material relative to a change in humidity. Control circuitry includes a charge deposition delay circuit that allows charging the electrodes a preset amount of time after the print head begins to scan across the paper web. The charge deposition delay circuitry varies the preset amount of time to compensate for the dimensional variations received from the memory. In this fashion, a spatial position of the latent electrostatic image in the strip may be adjusted to compensate for the dimensional variations in the paper web.

In a second embodiment, the measuring device includes a plurality of registration marks disposed upon the printable dielectric material and a position sensor adapted to sense a subset of the plurality of registration marks. A processor is connected to the position sensor and determines, from the subset, a magnitude of movement of the web in a first direction. Based upon the magnitude of movement, the processor determines the dimensional variations of the web in a second direction, orthogonal to the first direction. The position of the latent electrostatic image in the strip may be adjusted to compensate for the dimensional variations in the paper web.

In a third embodiment, the measuring device includes a plurality of registration marks disposed on one edge of the printable dielectric material, as well as a plurality of width marks disposed on an opposite edge of the printable dielectric material. A width detector is adapted to concurrently sense one of the registration marks and one of the width marks, disposed opposite thereto, defining a set of marks. A processor is connected to the width detector and determines a distance between the marks of the set. The width detector senses a plurality of sets as the printable dielectric material undergoes movement, and the processor means produces information corresponding to the dimensional changes. The position of the latent electrostatic image in the strip may be adjusted to compensate for the dimensional variations in the paper web.

BEST MODE FOR CARRYING OUT THE INVENTION

Figure 1:
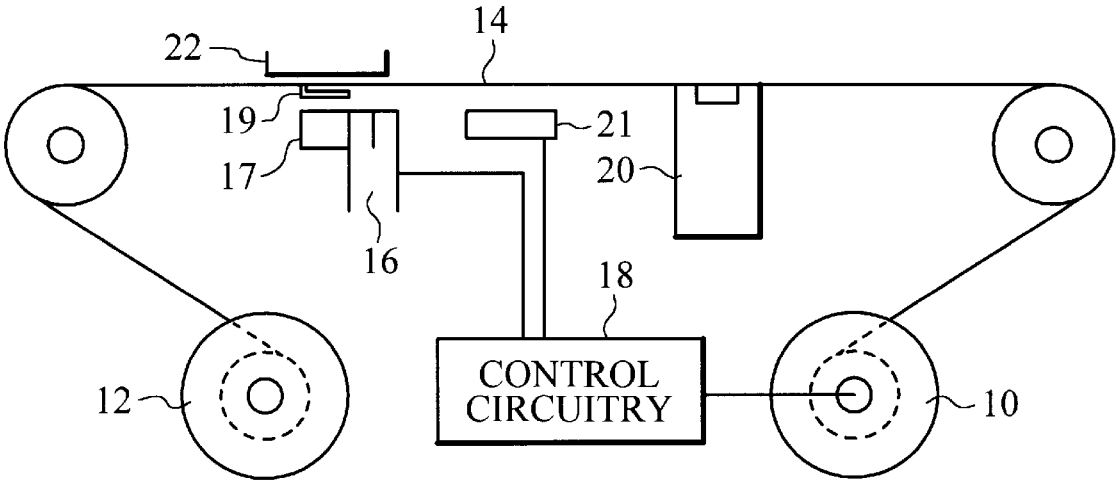
FIG. 1 is a simplified plan view of an electrostatic printing and copying apparatus utilizing a scanning electrostatic writing head in accord with the present invention.

Referring to FIG. 1, an electrostatic printing and copying system is shown in accord with the present invention. Paper supply roller 10 and take-up roller 12 maintain tension in paper web 14. An electrostatic writing head 16 is located between the supply 10 and take-up 12 rollers, adjacent to a planar segment of the web 14. Writing head 16 is a scanning head which moves across the width of paper web 14, depositing strips of electrostatic charges corresponding to strips of pixels of an image. Control circuitry 18 is in electrical communication with writing head 16 to control the deposition of the electrostatic charges on paper web 14. A toner applicator 20, located adjacent to writing head 16, spans the width of paper web 14. Liquid toner is supplied to applicator 20 and flows across the entirety of an exposed upper applicator surface, allowing charged toner particles to adhere to the oppositely charged regions of paper web 14. A backing support 22 resides above the writing head 16, such that paper web 14 is disposed therebetween.

After creation of a latent charge image, the paper motion is reversed and toning is accomplished while re-winding the web onto supply roller 10. To create multi-color images, different colors are sequentially deposited onto the paper web 14. This necessitates creation of multiple latent charges on any given area of the paper web 14 where multi-color images are desired. Paper supply 10 and take-up 12 rollers properly position paper web 14 under command of control circuitry 18 and in response to signals generated by a motion sensor 17 and a position sensor 21.

Motion sensor 17 is coupled to move with writing head 16 and is in data communication with a linear encoder 19. Linear encoder 19 extends across the width of paper web 14. Motion sensor 17 produces signals corresponding to the relative motion between sensor 17 and liner encoder 19. Control circuitry 18 is connected to receive the signals produced by motion sensor 17 and includes processing circuitry to determine, from the signals, the relative position of writing head 16 with respect to paper web 14. In this fashion, the movement of writing head 16 across the width of paper web 14 may be determined. Position sensor 21 produces signals which allows control circuitry 18 to determine the position of paper web 14 in a direction orthogonal to the width-wise direction thereof.

Figure 2:
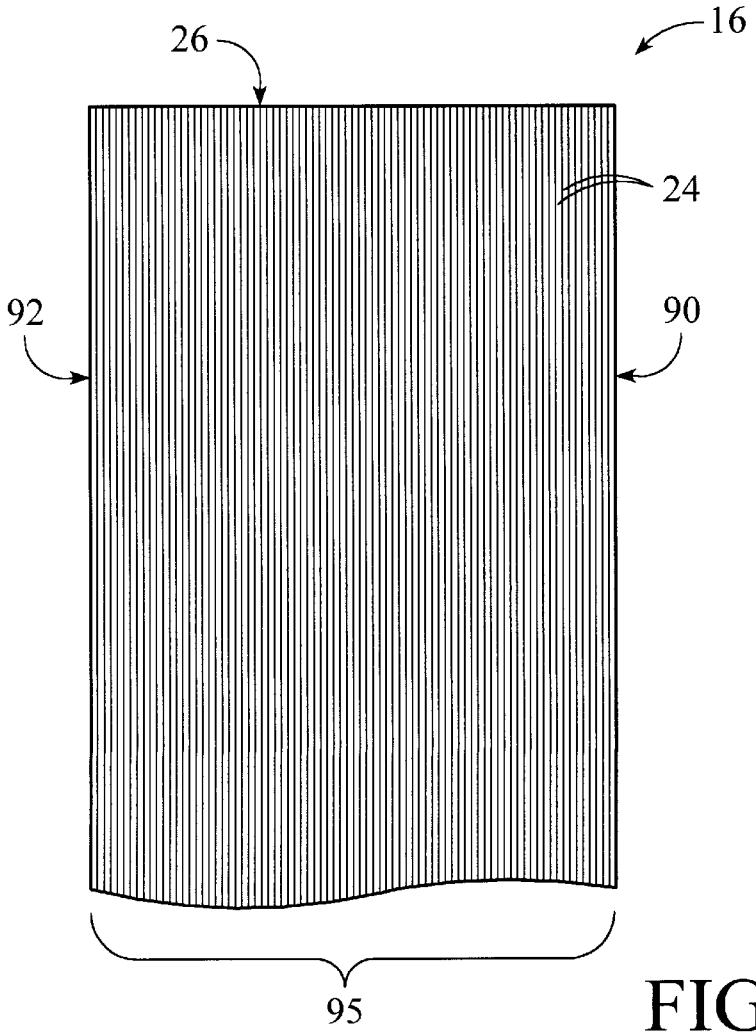
FIG. 2 is a partial side view of the scanning writing head shown in FIG. 1.
Figure 3:
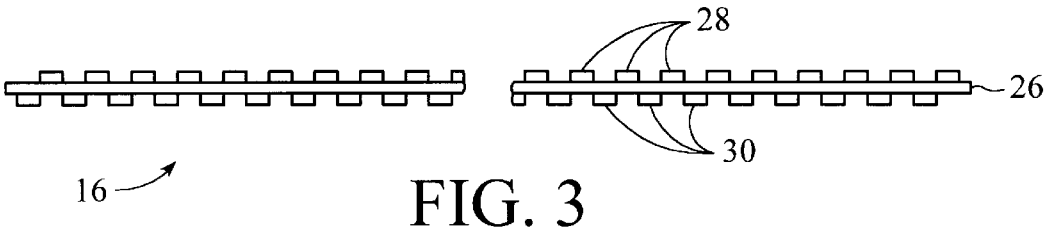
FIG. 3 is a magnified plan view of the writing head shown in FIG. 2.

FIG. 2 shows the writing head 16 consisting of very fine wires 24, or conductive traces, arranged as a parallel array on a thin circuit board 26. The wires or traces 24 function as electrodes, one end of which contacts the image receiving web for deposition of the latent charge image. The array of parallel wires or traces 24 extend completely across the board 26, on upper and lower surfaces, shown more clearly in FIG. 3, wherein the board 26 is shown on end. The writing head 16 includes an upper set of wires or traces 28 and a lower set of wires or traces 30. The board 26 is approximately 12.5 mils thick. The wires or electrodes are positioned at a combined density of more than 150 wires per centimeter or about 400 wires per inch, with 512 wires per side and an air or other insulative gap between adjacent wires so that they do not short together. As may be seen, the wires are slightly offset from each other, with a total of 1024 wires on two sides. This number is convenient for digital processing. With this configuration, the writing head 16 produces a 2.56 inch strip or swath of charge across the width of the paper web 14, shown in FIG. 4, creating a latent electrostatic image providing a resolution of 400 dpi.

Figure 4:
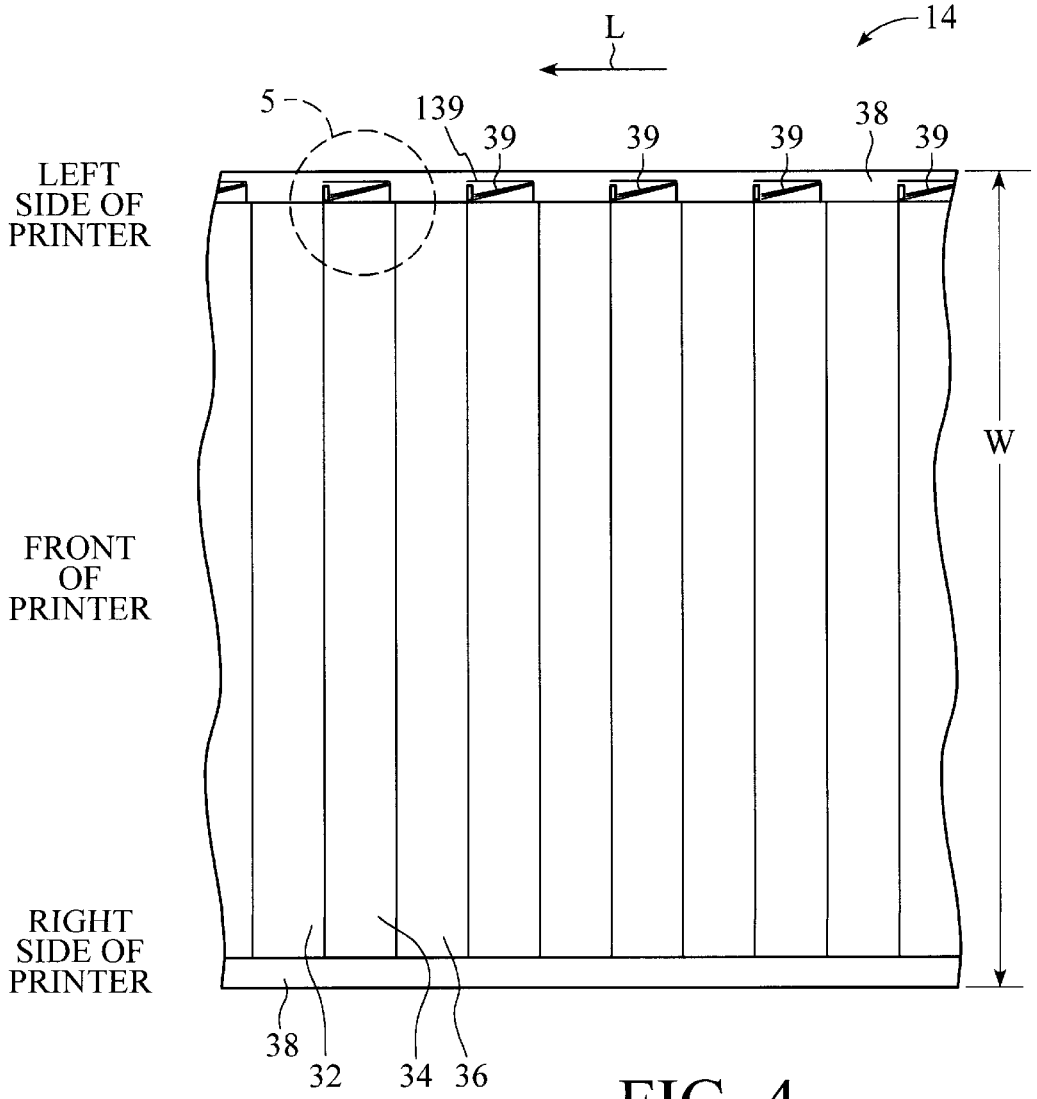
FIG. 4 is a partial top view of a paper web illustrating the scanning pattern of the present invention.

As seen in FIG. 4, a plurality of sequentially written image strips, 32, 34, 36 are formed by the writing head 16 moving across the width of paper web 14. Three strips are discussed with respect to FIG. 4 for demonstrative purposes. Typically, the number of image strips far exceeds three, with the actual number of strips written being limited by the application of the system. Opposing border portions 38 are disposed at opposite ends of each strip. Image writing does not occur in border portions 38. To print an image, writing head 16 scans across the width, W, of the paper web 14 while it is stationary, writing one strip. Paper web 14 is advanced, parallel to the lengthwise direction, L, thereof when writing head 16 is positioned outside the written area. Paper web 14 advances 2.56 inches in the direction of arrow L. After paper web 14 has stopped moving, writing head 16 scans across the width, W, of paper web 14 in the reverse, back-scan, direction to write the subsequent strip of a latent electrostatic image. The motion of the writing head 16 is synchronized across the width, W, via control circuitry 18, with the movement of the web 14 along direction L so that a pattern of abutting strips of charge areas is formed to write a complete latent image. The pattern then passes adjacent to applicator 20 where an appropriate color is deposited.

Figure 5:
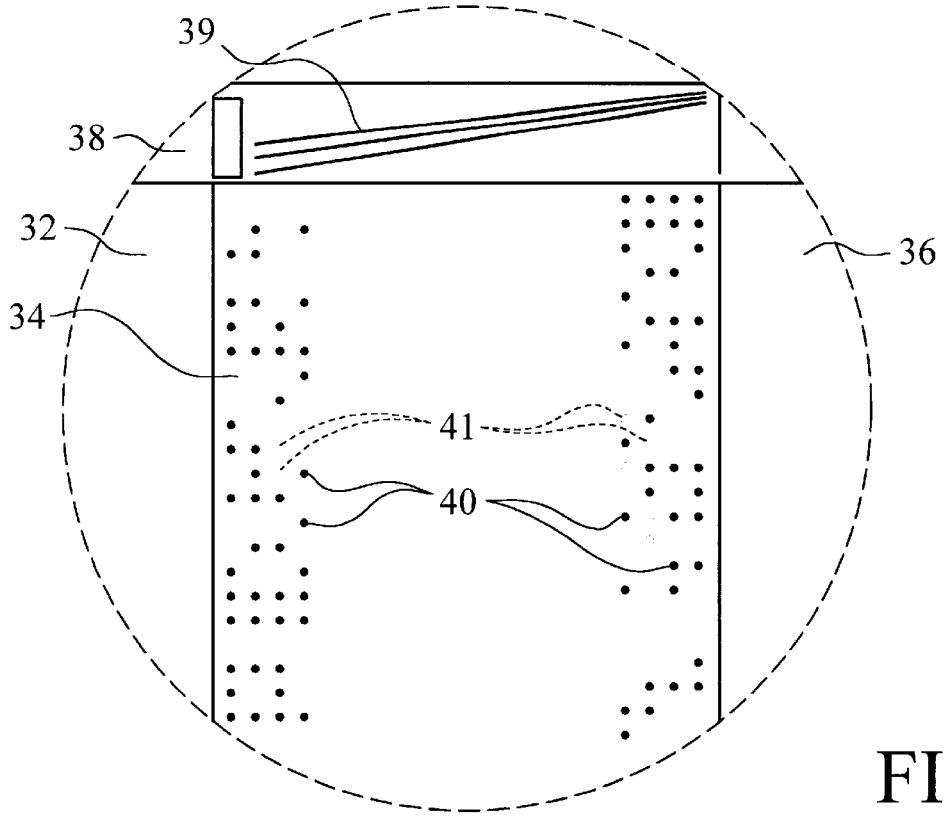
FIG. 5 is a detail view of the paper web shown in FIG. 4.

Referring to FIG. 5, a printing sample is shown within a strip indicated by the dashed circle 5, shown in FIG. 4. In FIG. 5, writing head 16 has moved over strip 34 and has charged a plurality of areas in the shape of dots 40, forming a primary dot pattern. Each dot 40 is formed by a write control module, incorporated into the control circuitry 18, which is discussed more fully below. Each of the charge areas are formed by applying a voltage to a single wire 24 of writing head 16, shown more clearly in FIGS. 3 and 4.

The charge areas are merely illustrative of the writing of digital words with bit patterns which span a strip from edge to edge. The bit patterns consist of arrays of charge dots deposited by the electrodes having either writing or non-writing potentials, typically −600 volts and −250 volts, respectively.

Referring to FIGS. 1 and 5, the array of charge dots is subsequently made visible upon toning by applicator 20. Where −600 volts is applied to an electrode, the resulting charge dot is toned, giving the dot a dark appearance. Where −250 volts is applied to an electrode, the resulting charge dot is too weak to attract toner particles and no visible dot is created. The voltages for writing and non-writing may differ somewhat from −600 volts and −250, respectively, depending on conditions, but these are typical voltages. The actual surface potential of the latent image dot, before toning, is typically in the range −100 to −150 volts. Since the deposited charge is quite localized, the pattern appears to be a grid-like array of charge areas. Each position in the array corresponds to an image pixel which is rendered either dark or light depending upon the charge deposited.

Figure 6:
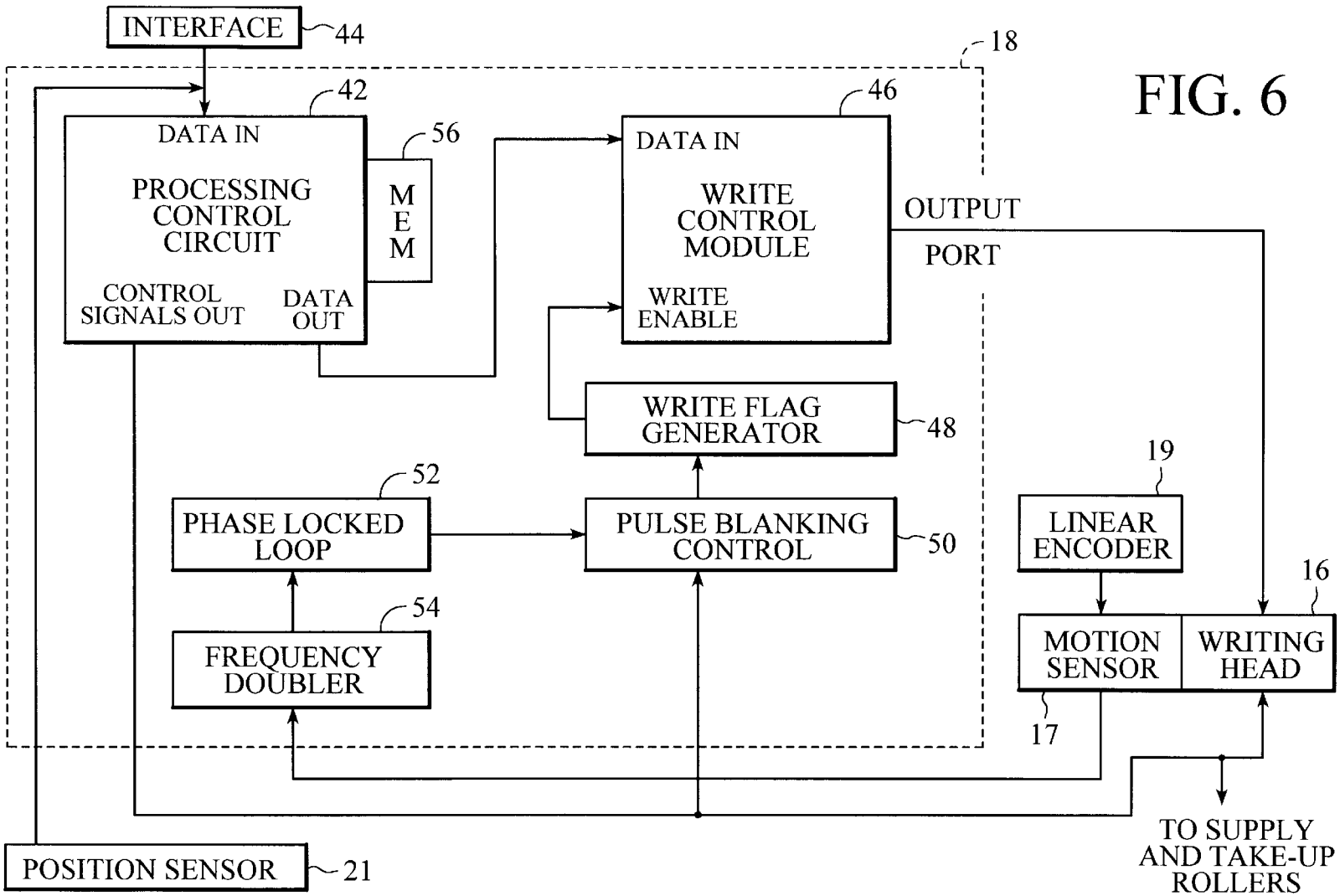
FIG. 6 is a block diagram of the apparatus shown in FIG. 1.
Figure 8:
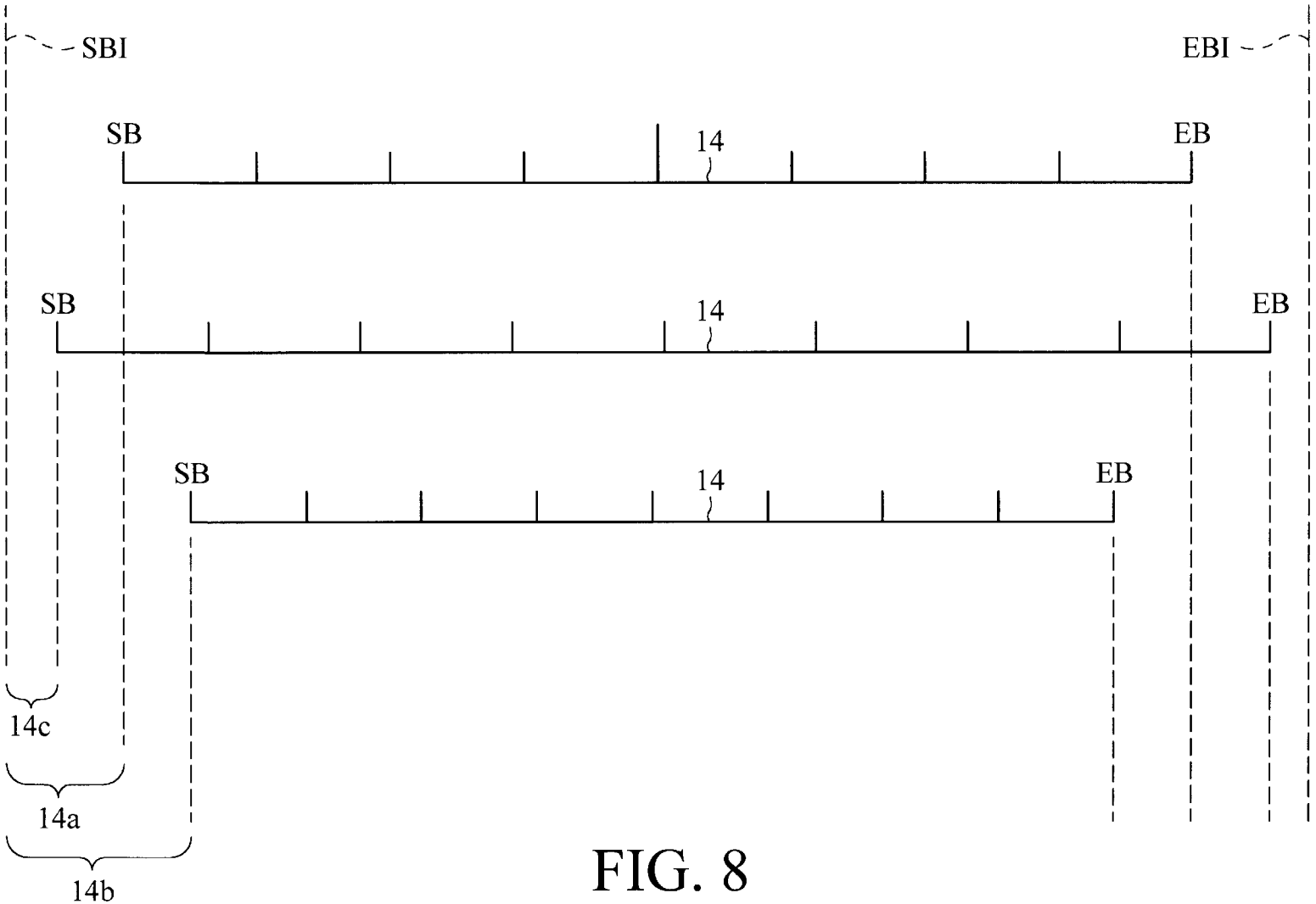
FIG. 8 is a plan view showing relative sizes of the paper web, shown in FIG. 4, at different humidity levels.

Referring to FIGS. 1 and 6, to govern the placement of an image on web 14, control circuitry 18 includes a processing control circuit 42 having a DATA IN terminal, a DATA OUT terminal and a CONTROL SIGNALS OUT terminal. The DATA OUT terminal is connected to a DATA IN terminal of a write control module 46. Write control module 46 includes an output port connected to writing head 16, and a WRITE ENABLE terminal. The WRITE ENABLE terminal is connected to an output of a write flag generator 48. An input of write flag generator 48 is connected to an output of a pulse blanking control 50, which has two inputs. One input of pulse blanking control 50 is connected to an output of a phase locked loop 52, the input of which is connected to a frequency doubler 54. Writing head 16 is electronically connected to control circuitry 18 so as to receive signals from both CONTROL SIGNALS OUT terminal and the output port of the write control module. Motion sensor 17 is connected to control circuitry 18 at an input of frequency doubler 54.

Data concerning the position of an image to be placed on web 14 is programmed into control circuit 18 via an interface 44, such as a computer keyboard, connected to the DATA IN terminal of a processing control circuit 42. Image data is transmitted from a DATA OUT terminal of processing control circuit 42 to a DATA IN terminal of a write control module 46. The output port of the write control module 46 is connected to writing head 16 so that image data may be sent thereto. By clocking the output port of write control module 46, the image may be properly positioned on web 14. Positioning of an image on the web 14 is critical when creating multi-color images.

Referring to FIGS. 1, 5 and 6, for example, each color to be applied to strip 34 requires properly positioning writing head 16 above paper web 14 so that the combined colors, deposited thereon, form a desired image. This is referred to as color registration. Failure to achieve the proper color registration could result in an image being blurred or unintelligible. To provide pixels of a different color, which correspond to the image associated with charge dots 40, a secondary pattern of charged dots 41 must be disposed within strip 34. After the secondary pattern has been deposited, the paper web 14 is advanced, as discussed above, so the same may be toned by applicator 20. Thus, it is critical to accurately align a plurality of latent electrostatic images within an electrostatic strip to achieve proper color registration.

To achieve proper color registration, writing head 16 forms, in one of the border portions 38, a latent image of registration marks 39 during the same scan in which the formation of the primary pattern of dots 40 in strip 34 occurs. Registration marks 39 are then toned by applicator 20, along with charge dots 40 of the primary pattern. Upon deposition of subsequent patterns, registration marks 39 are sensed by position sensor 21. By sensing registration marks 39, position sensor 21 produces a series of signals that are sent to the DATA IN terminal of processing control circuit 42, which causes supply 10 and take-up 12 rollers to precisely position paper web 14 with respect to both writing head 16 and applicator 20. In this fashion, the placement, along a direction parallel to L, of each pattern of dots may be precisely controlled, shown more clearly in FIG. 4.

Referring to FIGS. 1, 4, 5, 6 and 7, the placement of a pattern of dots along the width-wise, W, direction are controlled by properly ascertaining the position of writing head 16 within strip 34. To that end, motion sensor 17 is coupled to move with writing head 16, as the same scans across the width, W, of paper web 14. Motion sensor 17 includes a light source 17*a* disposed opposite to an optical detector 17*b*, with linear encoder 19 disposed therebetween. Linear encoder 19 consists of a strip which is opaque to the radiation produced by light source 17*a* and has a plurality of apertures lying along a common axis that extends parallel to the width-wise, W, direction. Each of the apertures corresponds to a unique spatial position along the widthwise, W, direction of the paper web 14. The apertures 23*a* disposed at opposing ends of linear encoder 19 correspond to one of the border portions 38, with the remaining apertures 23*b* corresponding to an area of strip 34 located between the opposed border portions 38.

Upon motion sensor 17 detecting one of apertures 23*a*, at the beginning of a scan, a start band index (SBI) pulse is produced. Motion sensor 17 produces an end band index (EBI) pulse upon detection of the aperture 23*a* corresponding to the opposing border portion 38, at the end of the scan. A plurality of pulses 60 are formed between the SBI and the EBI pulses, each of which corresponds to one of the apertures 23*b* of linear encoder 19, creating a position signal 62. After a predetermined number of pulses 60, a start of band (SB) pulse is produced, followed by an end of band (EB) pulse. The writing head 16 deposits the electrostatic image between the SB and EB pulses. The pulses between the SBI and SB pulses define the start band offset (SBO), and the pulses between the EBI and the EB pulses define the end band offset (EBO). Preferably, the number of apertures per inch are established so that position signal 62 includes 200 pulses 60 per inch.

Motion sensor 17 sends position signal 62 to frequency doubler 54, which doubles the number of pulses 60, creating a signal having 400 pulses per inch. The signal leaving frequency doubler 54 is sent to phase locked loop 52 to increase the resolution. Phase locked loop 52 produces a signal train of 12800 pulses per inch, which is sent to write flag generator 48 via a pulse blanking control 50. Write flag generator 48 produces 14080 bits of data per scan, which corresponds to the pulses per second sent from phase locked loop 52. In this fashion, a spatial position of motion sensor 17, with respect to linear encoder 19, is determined from the relation of each of the pulses 60 in the position signal 62 with respect to the SBI pulse. From this, the spatial position of the writing head 16, with respect to strip 34, may be determined, thereby allowing the bits of data, produced by write flag generator 48, to be sent to the WRITE ENABLE terminal of write control module 54 and charge writing head 16 appropriately to produce a desired dot pattern.

Referring to FIGS. 1 and 4, a problem encountered concerns dimensional changes in paper web 14. It was observed that the dimensional characteristics of paper web 14 varied parallel to both length-wise, L, and width-wise, W, directions, in relation to the humidity of the ambient atmosphere. Data obtained from position sensor 21 may be employed to compensate for length-wise, L, dimensional variations. Specifically, data received by processing control circuit 42 from position sensor 21 will result in advancement of supply 10 and take-up 12 rollers until the requisite portion, or number, of registration marks 39 is sensed. Dimensional changes along the width-wise direction, W, however, become problematic if the paper undergoes a dimensional change, because of humidity extremes affecting the moisture content of the web 14, between application of colors.

Figure 7:
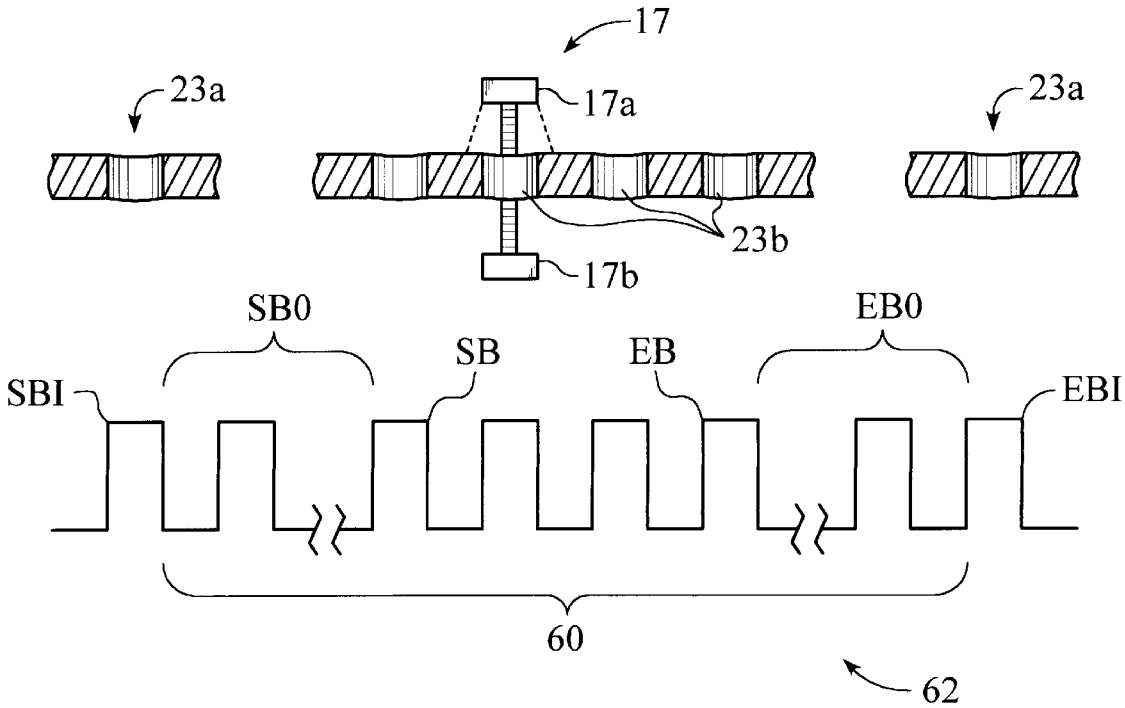
FIG. 7 is a side view of a motion sensor shown in FIGS. 1 and 6 and a data signal produced by the same, with a linear encoder shown in a cross-sectional side view.

Referring to FIGS. 1, 4 and 7, the correspondence between a spatial position, along strip 34, and linear encoder 19 varies. This can result in a change, between scans of writing head 16, of the spatial position of strip 34 to which any one of the pulses 60 corresponds. In order to compensate for dimensional variations of web 14 along the width-wise, W, direction, a memory 56 is in data communication with processing control circuitry 42 that contains a processor with a look-up table having data concerning a relative change in dimension of web 14 along the width-wise, W, direction with respect to a change in dimensions of web 14 along the length-wise, L, direction. For example, were web 14 formed from premium paper type 6200 dielectric coated electrographic paper manufactured by Rexam Graphics of South Hadley, Mass., memory 56*a* would contain information indicating that for every unit of dimensional change in the width-wise, W, direction, web 14 changes twice as much in the length-wise, L, direction. Although web 14 has been described as consisting of a particular type of paper, it is to be understood that any type of paper may be employed. For example, Rexam color report grade paper type 2089 may be used. The expansion and contraction ratio of length to width is 2.9/1 for this paper.

The information, however, from position sensor 21 may be used to compute dimensional changes in web 14 along the width-wise, W, direction. As discussed above, data received by processing control circuit 42, from position sensor 21, will result in advancement of supply 10 and take-up 12 rollers until the requisite portion, or number, of registration marks 39 is sensed. Data from the position sensor 21 is operated on by processing control circuit 42, taking into consideration the relative size of the supply 10 take-up 12 rollers, logic unit 56, to determine the amount of movement of web 14 was necessary before position sensor 21 sensed the requisite portion, or number, of registration marks 39. By comparing the change in movement of web 14 between scans of writing head 16, the processing control circuit 42 adjusts the SBO and EBO so that the writing head 16 properly positions the electrostatic image along the width-wise, W, direction.

For example, as shown in FIGS. 1, 6, 7 and 8, the SBO has a nominal length of 25,000 microinches, shown as 14*a*. Considering that there are 12800 pulses per inch, at the nominal length for the SBO, processing control circuit 42 would instruct pulse blanking control 50 to null 320 pulses 60, subsequent to the SBI pulse, before transmitting one to the write flag generator 48. Thereafter, for every 32 pulses received by the write flag generator 48, a bit would be written to the write enable port of the write control module 46. In this fashion, pulse blanking control 50 adjusts the time between the commencement of a scan of writing head 16, as initiated by processing control circuit 42, and the commencement of writing a pattern as governed by write control module 46. Specifically, the receipt of a write enable signal at write control module 46 is delayed by pulse blanking control 50, thereby delaying the commencement of forming a latent image on web 14.

Were the width, W, of the web 14 found to have contracted, for example 781.25 microinches, due to a decrease in humidity, the SBO shown as 14*b* would then be increased so that the SB pulse corresponded to the beginning of the strip 34. Specifically, the SBO would be increased by processing control circuit 42 instructing pulse blanking control 50 to count an additional 10 pulses, totalling 330 pulses, before transmitting one of the pulses 60 to the write flag generator 48. To ensure that the image fits on the web 14, along the width-wise direction, W, processing control circuit 42 pulse blanking control 50 to periodically add pulses 60 subsequent to the SB pulse. This, in effect, reduces the size of the image formed on tie web 14 by reducing the width of the same. It is preferred that the pulses added subsequent to the SB pulse be input at equal intervals across the scan, i.e., between the SB and EB pulse, so that the information is shifted in a linear manner. This offsets the latent electrostatic image formed on the web by the appropriate distance, while reducing the size of the same to achieve proper color registration.

Conversely, were the web 14 to expand, for example, 781.25 microinches, due to an increase in humidity, the SBO, shown as 14*c*, would then be decreased by processing control circuit 42 instructing pulse blanking control 50 to count 10 fewer pulses, totalling 310 pulses, before transmitting one of the pulses 60 to the write flag generator 48. The size of the image would then be increased by deleting a number of pulses 60 linearly across the web that would be supplied to the write flag generator 48.

Figure 9:
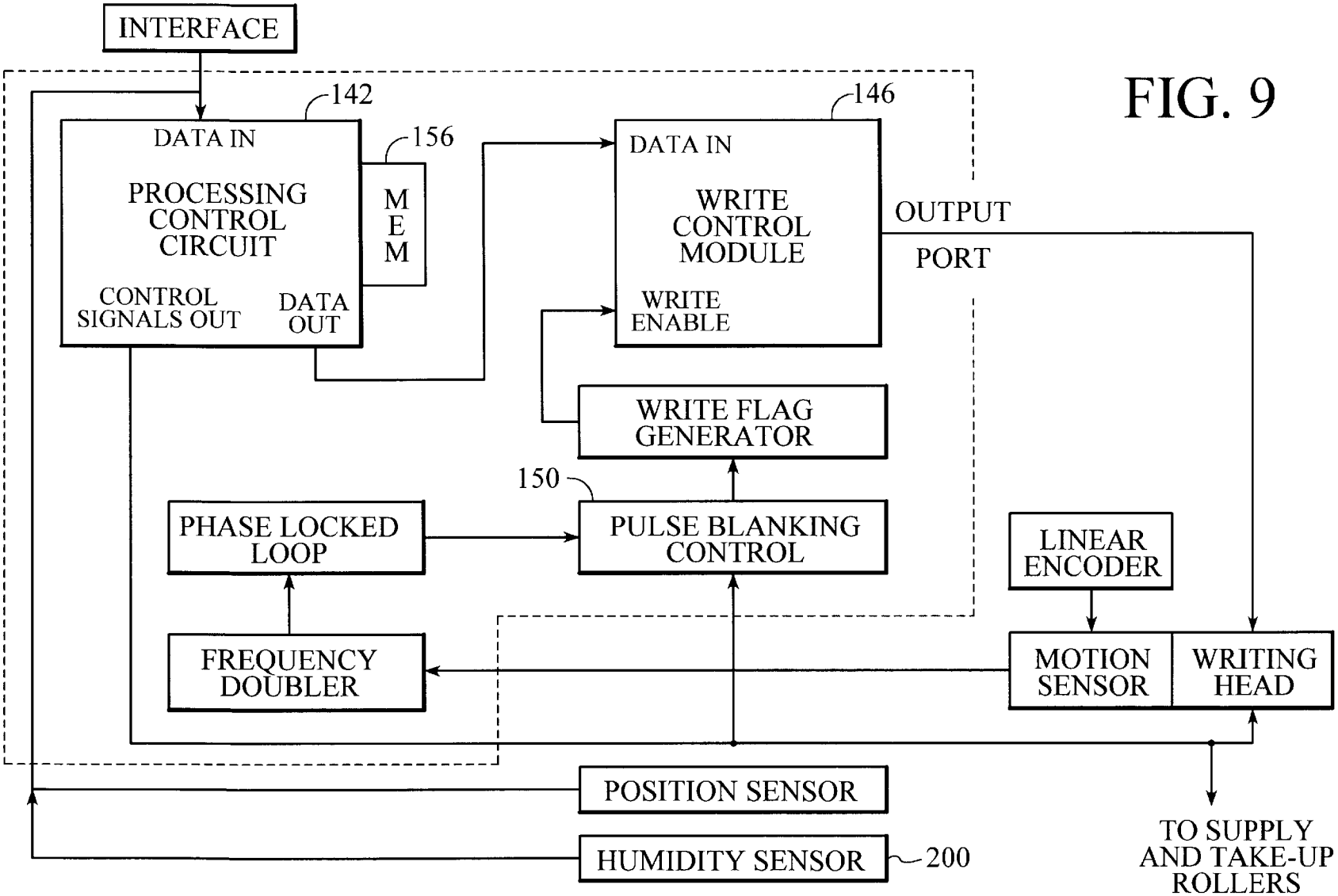
FIG. 9 is a block diagram of the present invention employing a humidity sensor, in accord with an alternate embodiment.

Referring to FIGS. 1 and 9, in an alternate embodiment an output of a humidity sensor 200 is connected to processing control circuit 142. Memory 156 contains a look-up table having data concerning a relation between change in dimension of web 14 along the width-wise, W, direction to a change in the humidity of the ambient atmosphere. In this configuration, humidity sensor 200 sends information to processing control circuit 142 concerning the humidity of the ambient atmosphere. Processing control circuit 142 then operates upon memory 156 to obtain data concerning the dimensional measurements of web 14 that correspond to the measured humidity of the ambient atmosphere. Similar to the embodiment discussed above, processing control circuit 142 then transmits information to pulse blanking control 150 related to the dimensional change in web 14. In response to the information received from processing control circuit 142, pulse blanking control 50 adjusts the time between the commencement of a scan of writing head 16 and the commencement of writing a pattern, as governed by write control module 146, and discussed above. This allows proper positioning of the latent electrostatic image on web 14 despite variations in humidity of the ambient atmosphere.

Figure 10:
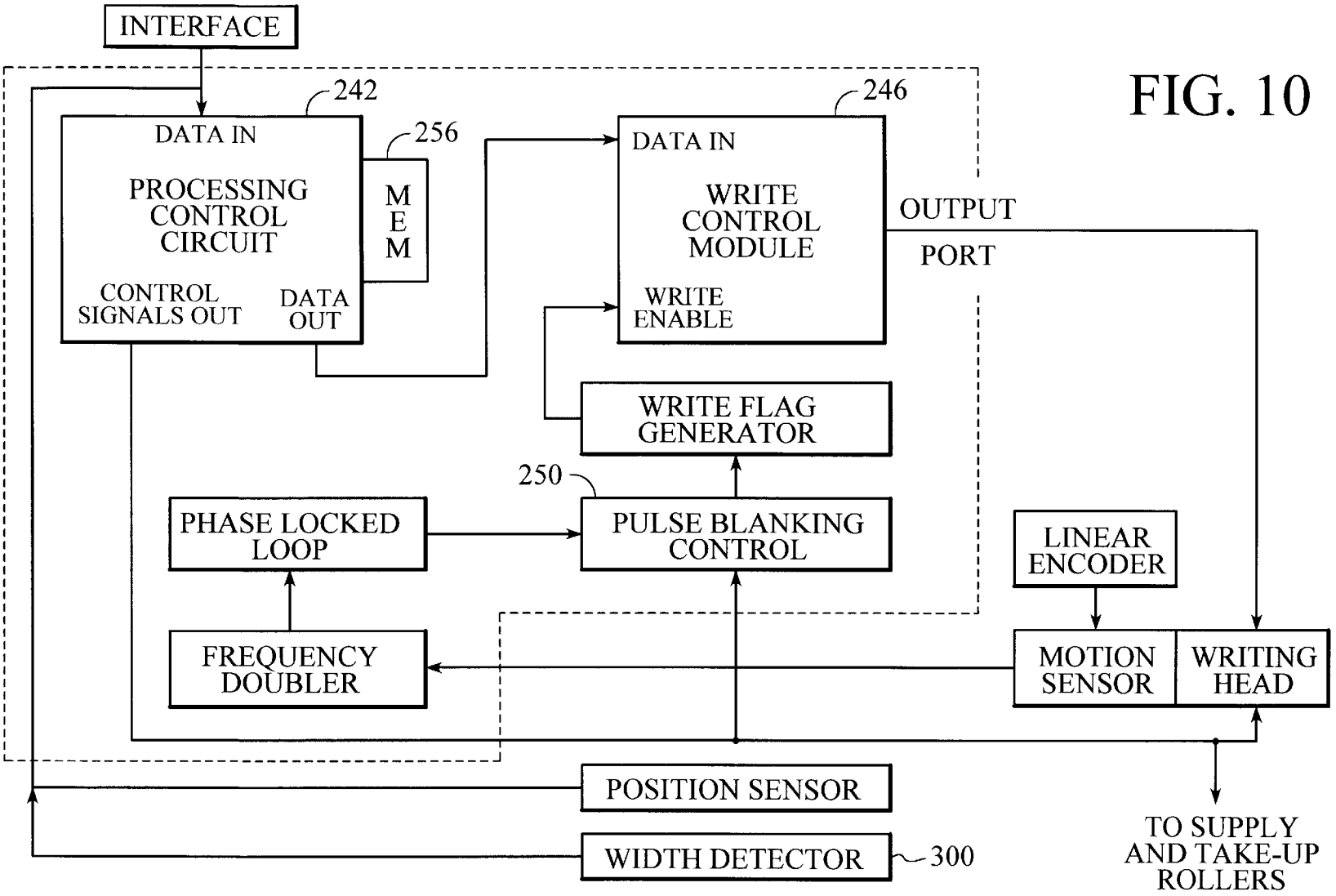
FIG. 10 is a block diagram of the present invention employing a width detector, in accord with an alternate embodiment.

Referring to both FIGS. 1, 4 and 10, instead of a humidity sensor, a width detector 300 is connected to the input of processing control circuit 242. Width detector 300 may consist of a CCD array disposed to sense both border portions 38, concurrently. To take advantage of width detector 300, writing head 16 would dispose, in the border portion 38 located opposite to registration marks 39, width marks 139. Width marks 139 may be identical to registration marks 39. Width detector 300 would function to directly measure the separation between registration marks 39 and width marks 139 and generate information related to said separation. The information produced by width detector 300 is sent to processing control circuit 242, which then transmits information to pulse blanking control 250 related to the dimensional change in web 14, along the width-wise, W, direction. In response to the information received from logic unit 256, pulse blanking control 250 adjusts the time between the commencement of a scan of writing head 16 and the commencement of writing a pattern by write control module 246, as discussed above. This also allows properly positioning of a latent electrostatic image upon web 14, despite variations in a dimension of the same. An advantage with this embodiment is that compensation may be achieved independently of the cause of dimensional variations in web 14.

I claim:

1. An electrostatic printer comprising, a linear supply of dimensionally variable, electrostatically printable, dielectric material movable in a lengthwise first direction an electrostatic writing head scanning in a widthwise direction, transverse to the lengthwise direction, during a time period to deposit an electrostatic latent image thereon and a motion sensor means, attached to said writing head for producing a plurality of pulses corresponding to the movement of said writing head, control circuitry means coupled to the motion sensor means, synchronized with said plurality of pulses corresponding to the movement of said writing head, means for advancing the supply of dielectric material in the lengthwise first direction, means for determining dimensional variations in said dielectric material due to environmental changes and producing signals corresponding thereto; and a charge deposition delay circuit in electrical communication with said writing head, said delay circuit being coupled to receive said signals and pulses to adjust said electrostatic latent image on said dielectric material in accordance with said dimensional variations, whereby additional latent electrostatic images may be properly aligned with respect to said latent electrostatic image to allow placement of a plurality of latent electrostatic images on said dielectric material.

2. The printer as recited in claim 1 wherein said determining means includes a moisture sensor adapted to detect a relative humidity of an ambient atmosphere, producing information corresponding thereto, a processor in electronic communication with said moisture sensor, said processor having a memory storing data concerning a relative change in dimensions of said dielectric material corresponding to changes in humidity detected by the moisture sensor.

3. The printer as recited in claim 1 wherein said determining means includes a plurality of registration marks disposed upon said dielectric material, a position sensor, wherein said dielectric material is adapted to undergo movement along the first direction with respect to said position sensor, with said position sensor positioned to sense a subset of said plurality of registration marks during said movement, and a processor, in electronic communication with said position sensor, for determining, from said subset, a magnitude of said movement and said dimensional variations of said dielectric material in a second direction, oriented transverse to said first direction.

4. The printer as recited in claim 1 wherein said determining means includes a plurality of registration marks disposed proximate to one edge of said dielectric material, a plurality of width marks disposed on an opposite edge of said dielectric material, a width detector adapted to sense a distance between one of said registration marks and one of said width marks.

5. An electrostatic printer, comprising:

a supply of dimensionally variable, electrostatically printable, dielectric material;

means for advancing the dielectric material along a path in a first direction, means for depositing, on said dielectric material, an electrostatic latent image, said means for deposing having an electrostatic writing head, a processing control circuit and a write control module, said processing control circuit being coupled to send control signals to cause said writing head to scan across a width of said dielectric material, during a first time period, with a motion sensor means, attached to said writing head, for producing a plurality of pulses corresponding to the movement of said writing head, means, positioned adjacent to said dielectric material, for toning said electrostatic latent image;

means for determining dimensional variations in said dielectric material due to environmental changes and produce signals corresponding thereto; said write control module being coupled to receive said signals indicative of environmental changes, synchronized with said plurality of pulses, and a charge deposition delay circuit in electrical communication with said depositing means, said delay circuit being coupled to receive said signals and pulses to adjust said latent electrostatic image with said charge deposition delay circuit changing, during said first time period, a predetermined number of said plurality of pulses to adjust a spatial position of said latent electrostatic image on said dielectric material, and changing, during a second time period, a multiple number of said plurality of pulses thereby adjusting a spatial dimension of said electrostatic latent image without loss of information pertaining to the electrostatic latent image.

6. The printer as recited in claim 5 wherein said determining means includes a humidity sensor adapted to detect a relative humidity of an ambient atmosphere, producing information corresponding thereto, a processing control circuit including a memory, said memory storing data concerning changes in dimensions of said dielectric material in relation to corresponding changes in humidity, wherein said processing control circuit determines, from said data, said dimensional variations.

7. The printer as recited in claim 5 wherein said determining means includes a plurality of registration marks disposed upon said dielectric material, and further includes a position sensor adapted to sense a subset of said plurality of registration marks as said dielectric material moves along said first direction, and a processor, in electronic communication with said position sensor, for determining, from said subset, a magnitude of said movement and said dimensional variations of said material, in a second direction, orientated orthogonal to said first direction, from said magnitude.

8. The printer as recited in claim 5 wherein said determining means includes a plurality of registration marks disposed proximate to one edge of said dielectric material, a plurality of width marks disposed on an opposite edge of said dielectric material, a width detector adapted to concurrently sense one of said registration marks and one of said width marks, disposed opposite thereto, defining a set of marks, and a processor, in electronic communication with said width detector, for determining a distance between the marks of said set, whereby said width detector senses a plurality of sets as said dielectric material undergoes relative movement with respect to said means for depositing the electrostatic latent image, said processor means producing said signals corresponding to said dimensional changes.

9. An electrostatic printer comprising:

a supply of dimensionally variable, electrostatically printable, dielectric material;

an electrostatic head means for writing, on said dielectric material, an electrostatic strip containing a latent electrostatic image, said head means being adapted to scan across a width of said dielectric material during a first time period;

a charging circuit, electrically coupled to said head means, for charging said electrostatic head means to a specified voltage level during a second time period, with an offset between the first and second time periods defined by an amount of time, means, electronically coupled to said charging circuit, for determining dimensional variations in said dielectric material due to atmospheric changes and adjusting said amount of time to compensate for said dimensional variations, whereby said dielectric material may be properly aligned for successive depositions of additional electrostatic images thereon; and means, adjacent to said head means, for applying a fluid developer to said latent electrostatic image, thereby producing a visible image.

10. The printer as recited in claim 9 wherein said determining means includes a humidity sensor adapted to detect a relative humidity of an ambient atmosphere, producing information corresponding thereto, a processing control circuit and a memory, in electronic communication with said processing control circuit, said memory storing data concerning a change in dimensions of said dielectric material relative to a change in humidity, wherein said processing control circuit determines, from said data, said dimensional variations.

11. The printer as recited in claim 9 further including means for moving said supply along a first direction, wherein said determining means includes a plurality of registration marks disposed upon said dielectric material, a position sensor adapted to sense a subset of said plurality of registration marks as said dielectric material moves along said first direction, and a processor, in electronic communication with said position sensor, for determining, from said subset, a magnitude of said movement and said dimensional variations of said dielectric material in a second direction, oriented orthogonal to said first direction, from said magnitude.

12. The printer as recited in claim 9 wherein said determining means includes a plurality of registration marks disposed proximate to one edge of said dielectric material, a plurality of width marks disposed on an opposite edge of said dielectric material, a width detector adapted to sense a distance between one of said registration marks and one of said width marks, disposed opposite thereto.

13. The printer as recited in claim 9 wherein said charging circuit includes a processing control circuit and a write control module, said processing control circuit being coupled to send control signals to cause said head means to scan across a width of said dielectric material, during said first time period, with a motion sensor means, attached to said head means, for producing a plurality of pulses corresponding to the movement of said head means, said write control module being coupled to send a data signal, synchronized with said plurality of pulses, to cause said head means to adjust said latent electrostatic image during said second time period, with said determining means cancelling, during said first time period, a predetermined number of said plurality of pulses to adjust said spatial position of said latent electrostatic image on said dielectric material, and periodically cancelling or adding in the second time period a multiple of said plurality of pulses, thereby adjusting a spatial dimension of said electrostatic image.

14. A method of producing an image on a dimensionally changeable substrate for electrostatic printing thereon using a scanning electrostatic head, comprising the steps of:

scanning said head across said substrate during a first time period;

charging said head during a second time period to produce a latent electrostatic image on said substrate, with a start of said first time period being offset from said second time period by a preset amount of time;

measuring dimensional variations of said substrate and producing information corresponding thereto;

adjusting said preset amount of time in accordance with said information to vary a spatial position of said latent electrostatic image on said substrate, thereby compensating for said dimensional variations to properly align successive depositions of additional electrostatic images thereon; and producing a visible image by toning said latent electrostatic image.

15. The method as recited in claim 14 wherein said measuring step includes measuring humidity of an ambient atmosphere.

16. The method as recited in claim 14 wherein said substrate includes a plurality of registration marks disposed proximate to one edge of said dielectric material and a plurality of width marks, each of which is disposed opposite to one of said plurality of registration marks, and further including, determining a distance between one of said plurality of registration marks and one of said width marks.

17. The method as recited in claim 14 wherein said substrate includes a plurality of registration marks disposed proximate to one edge of said substrate and further including, sensing a distance between a subset of said plurality of registration marks as said substrate moves and determining from said distance said dimensional variations.

* * * * *